US005987780A

United States Patent [19]

Lyden et al.

[11] Patent Number: 5,987,780

[45] **Date of Patent: *Nov. 23, 1999**

[54] SHOE SOLE INCLUDING A PERIPHERALLY-DISPOSED CUSHIONING BLADDER

[75] Inventors: Robert M. Lyden, Beaverton; Michael A. Aveni, Lake Oswego, both of Oreg.

[73] Assignee: Nike, Inc., Beaverton, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,202

[22] Filed: Jan. 10, 1997

Related U.S. Application Data

[62] Division of application No. 08/220,032, Mar. 30, 1994, Pat. No. 5,595,004.

[51] Int. Cl.[6] ..... A43B 13/20; A43B 21/26; A43B 7/14

[52] U.S. Cl. ..... 36/29; 36/35 B; 36/153

[58] Field of Search ..... 36/25 R, 28, 29, 36/30 R, 32 R, 35 B, 114, 153

[56] References Cited

U.S. PATENT DOCUMENTS

| | | | |
|---|---|---|---|
| 896,075 | 8/1908 | Badgliey | 36/29 X |
| 1,625,582 | 4/1927 | Anderson . | |
| 2,128,134 | 8/1938 | Giusto . | |
| 2,365,027 | 12/1944 | Urbany | 36/29 |

(List continued on next page.)

FOREIGN PATENT DOCUMENTS

| | | | |
|---|---|---|---|
| 283 117 | 9/1988 | European Pat. Off. . | |
| 549962 | 7/1993 | European Pat. Off. . | |
| 913187 | 8/1946 | France . | |
| 1018215 | 12/1952 | France . | |
| 2 614 510 | 11/1988 | France . | |
| 470996 | 2/1929 | Germany . | |
| 3245182 | 5/1983 | Germany | 36/134 |
| 33 17 460 | 10/1993 | Germany . | |
| 81 605 | 10/1986 | Taiwan . | |
| 123336 | 3/1990 | Taiwan . | |
| 134 162 | 9/1990 | Taiwan . | |
| 160 500 | 6/1991 | Taiwan . | |
| 173 484 | 11/1991 | Taiwan . | |
| 184 346 | 5/1992 | Taiwan . | |
| 8 785 | 4/1911 | United Kingdom . | |
| 390368 | 4/1933 | United Kingdom . | |
| 503887 | 4/1939 | United Kingdom . | |
| 2 023 405 | 1/1980 | United Kingdom . | |
| 2 034 169 | 6/1980 | United Kingdom . | |
| 2 188 825 | 10/1987 | United Kingdom . | |
| 2200831 | 8/1988 | United Kingdom . | |
| WO 90/10396 | 9/1990 | WIPO . | |
| WO 91/10377 | 7/1991 | WIPO . | |
| WO 91/11924 | 8/1991 | WIPO . | |

OTHER PUBLICATIONS

Nike Spring Footwear Brochure, 1993 "Air Max" Shoes.

Adidas Advertisement.

*Primary Examiner*—B. Dayoan

*Attorney, Agent, or Firm*—Banner & Witcoff, Ltd.

[57] ABSTRACT

An athletic shoe including an upper and a sole. The sole includes a cushioning bladder including a sealed, fluid-filled tube disposed about the perimeter of the shoe. In one embodiment, the bladder includes lateral and medial portions extending about the heel and forwardly towards the forefoot to define a central region occupying a substantial portion of the heel and forefoot of the shoe. No portion of the tube extends within the central region, which may be occupied by ambient air or by a second bladder or chamber which is not in fluid communication with the tube. In an alternative embodiment, the bladder includes a tube having lateral, medial and transverse portions, with the transverse portion extending between the medial and lateral portions at the instep area of the shoe, to define a central forefoot region. In a further alternative embodiment, both a central forefoot and a central heel area may be defined. The shoe may further include a substantially rigid footframe disposed directly above the bladder and spanning the lateral and medial sides.

18 Claims, 14 Drawing Sheets

U.S. PATENT DOCUMENTS

| | | | |
|---|---|---|---|
| 2,434,770 | 1/1948 | Lutey . | |
| 2,468,886 | 5/1949 | Lutey . | |
| 3,225,463 | 12/1965 | Burnham . | |
| 3,251,144 | 5/1966 | Weitzner . | |
| 3,350,795 | 11/1967 | Schlecht . | |
| 3,765,422 | 10/1973 | Smith | 36/153 |
| 4,000,566 | 1/1977 | Famolare, Jr. | 36/28 |
| 4,008,530 | 2/1977 | Gager | 36/28 |
| 4,043,058 | 8/1977 | Hollister et al. | 36/102 |
| 4,128,950 | 12/1978 | Bowerman et al. | 36/30 R |
| 4,129,951 | 12/1978 | Petrosky | 36/29 |
| 4,144,659 | 3/1979 | Eisenberg | 36/28 X |
| 4,183,156 | 1/1980 | Rudy | 36/44 |
| 4,217,705 | 8/1980 | Donzis | 36/29 |
| 4,219,945 | 9/1980 | Rudy | 36/29 |
| 4,229,889 | 10/1980 | Petrosky | 36/29 |
| 4,271,606 | 6/1981 | Rudy | 36/29 |
| 4,297,797 | 11/1981 | Meyers | 36/44 |
| 4,305,212 | 12/1981 | Coomer | 36/80 |
| 4,340,626 | 7/1982 | Rudy | 428/35 |
| 4,439,936 | 4/1984 | Clarke et al. | 36/102 |
| 4,445,283 | 5/1984 | Meyers | 31/29 |
| 4,446,634 | 5/1984 | Johnson et al. | 36/29 |
| 4,471,538 | 9/1984 | Pomeranz et al. | 36/28 |
| 4,486,964 | 12/1984 | Rudy | 36/28 |
| 4,506,460 | 3/1985 | Rudy | 36/102 |
| 4,562,651 | 1/1986 | Frederick et al. | 36/102 |
| 4,567,677 | 2/1986 | Zona | 36/43 |
| 4,593,482 | 6/1986 | Mayer | 36/28 X |
| 4,610,099 | 9/1986 | Signori | 36/38 |
| 4,617,745 | 10/1986 | Batra | 36/38 |
| 4,722,131 | 2/1988 | Huang | 29/450 |
| 4,747,219 | 5/1988 | Ammendolea | 36/28 |
| 4,754,559 | 7/1988 | Cohen | 36/38 |
| 4,768,295 | 9/1988 | Ito | 36/28 |
| 4,779,359 | 10/1988 | Famolare, Jr. | 36/29 |
| 4,782,603 | 11/1988 | Brown | 36/29 |
| 4,817,304 | 4/1989 | Parker et al. | 36/114 |
| 4,845,863 | 7/1989 | Yung-Mao | 36/114 |
| 4,852,273 | 8/1989 | Hamy | 36/28 |
| 4,852,274 | 8/1989 | Wilson | 36/28 X |
| 4,893,421 | 1/1990 | Folks | 36/132 |
| 4,894,933 | 1/1990 | Tonkel et al. | 36/28 |
| 4,906,502 | 3/1990 | Rudy | 36/29 X |
| 4,914,836 | 4/1990 | Horovitz | 36/28 |
| 4,974,344 | 12/1990 | Ching | 36/101 |
| 4,991,317 | 2/1991 | Lakic | 36/44 |
| 5,005,299 | 4/1991 | Whatley | 36/25 R |
| 5,010,662 | 4/1991 | Dabuzhsky et al. | 36/28 |
| 5,014,449 | 5/1991 | Richard et al. | 36/114 |
| 5,083,361 | 1/1992 | Rudy | 29/454 |
| 5,195,256 | 3/1993 | Kim | 36/29 |
| 5,224,277 | 7/1993 | Sang Do | 36/27 |
| 5,245,766 | 9/1993 | Warren | 36/29 |
| 5,406,719 | 4/1995 | Potter | 36/28 |
| 5,425,184 | 6/1995 | Lyden | 36/29 |
| 5,595,004 | 1/1997 | Lyden et al. | 36/29 |
| 5,598,645 | 2/1997 | Kaiser | 36/28 X |

SHOE SOLE INCLUDING A PERIPHERALLY-DISPOSED CUSHIONING BLADDER

This application is a division of application Ser. No. 08/220,032, filed Mar. 30, 1994, now U.S. Pat. No. 5,595, 004.

BACKGROUND OF THE INVENTION

1. Technical Field

The present invention is directed to footwear, and in particular, to a shoe sole having a sole including a sealed, fluid-filled viscoelastic cushioning element such as a gas-filled bladder.

2. The Prior Art

Footwear including soles made of a resiliently compressible midsole disposed above a substantially flexible, wear-resistant outsole are known in the art. Such midsoles have been made of conventional foam materials, for example, ethylene vinyl acetate (EVA) or polyurethane which compress resiliently under an applied load and dampen to provide cushioning. The outsoles have been made of conventional wear-resistant materials such as a carbon-black rubber compound. Conventional foam materials are resiliently compressible, in part, due to the inclusion in the foam of open or closed cells defining an inner volume that is substantially displaced by gas. That is, the foam can include bubbles formed in the material which include air therein. However, after repeated compression, foam materials deteriorate, in particular, by compaction. The cell structure collapses, resulting in decreased compressibility of the foam. Thus, the overall cushioning of the midsole deteriorates.

One way to overcome the drawbacks of using conventional foam materials is disclosed in U.S. Pat. No. 4,183,156, incorporated by reference, in which cushioning is provided by inflatable inserts made of elastomeric materials. The inserts include a plurality of tubular chambers which extend substantially longitudinally throughout the length of the shoe. The chambers are in fluid communication with each other at the forefoot and jointly extend across the width of the shoe. In one embodiment, the insert is disposed upon a relatively thick outsole, within the shoe upper. A moderator is placed over the insert and also is disposed within the shoe upper. The moderator is made of a semi-flexible material which allows it to conform to the changing contours of the plantar surface of the wearer's foot. The shoe upper is secured to upper surfaces of the outsole such that the outsole, the lower side portions of the shoe upper and the moderator define a chamber in which the insert is contained. In a second embodiment, the insert is disposed within a cavity formed in an elastic portion of the outsole.

In each of the above-described embodiments, cushioning is provided, at least in part, by resilient compression of the elastic insert. However, in the first embodiment, compression of the insert requires relative movement of the foot with respect to the upper, within the volume defined by the upper, moderator and outsole. Relative movement between the foot and the upper can cause callouses, blisters and other problems. Further, positioning of the insert within the upper inherently is restrictive, for example, the degree to which the insert may elastically deform under load is inhibited. Thus, the degree to which the insert can be compressed and the degree of cushioning which can be provided thereby is limited. In the second embodiment, the overall cushioning achieved by the sole is due in part to the foam elastic material which is disposed about the inflated insert. Thus, when the foam material deteriorates, the quality of cushioning afforded by the shoe can decline. As with the upper in the first embodiment, the elastic material disposed about the insert can restrict the degree to which it can compress, thereby limiting cushioning.

In U.S. Pat. No. 4,219,945, incorporated by reference, an inflated insert may be encapsulated in a foam material. The combination of the insert and the encapsulating material functions as the midsole. An upper is cemented to the upper surface of the encapsulating material and an outsole or tread member may be fixed to the lower surface. As with the second embodiment of the above-discussed patent, the degree to which the insert may compress and thus the cushioning provided thereby, is limited by the encapsulating material. Overall cushioning can decrease as the foam material deteriorates with use, and the use of a completely encompassing foam increases the weight of the shoe. Further, the impact response of such a sole structure is determined by the combined effects of both the insert and the foam material. Factors such as the relative volume of the two elements, the type of foam material used and the pressure of the enclosed gas varies the amount each element contributes to the impact response and the nature of the response. Accordingly, the use of both foam material and an insert can complicate engineering the cushioning response to particular requirements.

U.S. Pat. No. 4,817,304, incorporated by reference, discloses a foam encapsulated air insert in which gaps are left along the sides of the encapsulating member. When the midsole is compressed, the insert expands into the gaps. Thus, the gaps provide decreased stiffness in compression of the midsole, while reducing the overall weight of the shoe. Further, by appropriately locating the gaps, the overall impact response characteristics can be tuned along the length of the shoe. However, as with the above-discussed patent, the use of a substantial quantity of foam material throughout the shoe midsole increases the weight of the shoe, inhibits flexibility and increases the stiffness in compression of the midsole at locations other than the gaps. Further, the midsole suffers the drawback of deterioration of the overall cushioning as the foam material degrades with use.

U.S. Pat. No. 4,722,131, incorporated by reference, discloses an air cushioning sole made of an elastomeric material which is disposed between an upper and a shoe bottom sole. The cushioning sole may be formed by blow molding and in one embodiment, includes two separate sections which jointly extend across the length and width of the shoe. Each section includes a separate air valve to allow the cavities to be inflated to a different pressure.

In one embodiment, the cushioning sole includes a forefoot section formed to include a forefoot chamber extending along the medial and lateral sides of the forefoot, and a plurality of transverse chambers extending across the shoe between the lateral and medial portions of the forefoot chamber. The sole also includes a separate heel section, and a separate air valve to inflate each section. The transverse chambers are in fluid communication with each other by small connecting tubes formed between each transverse tube along the longitudinal axis of the cushioning sole, with the forward and rear transverse chamber linked to the forefoot chamber.

Since the forefoot chamber is in fluid communication with the transverse chambers, the cushioning area covered by the forefoot cavity is essentially the entire forefoot of the shoe. Thus the effective volume of the cushioning sole at the forefoot is large relative to the area of the shoe it covers, potentially making the cushioning sole unstable. This instability may be overcome by greatly increasing the pressure within the cushioning sole. However, increasing the pressure to a level which overcomes the instability can result in a cushioning sole having a greatly increased stiffness in compression, thereby making the cushioning sole too firm to provide an acceptable level of cushioning. Further, large increases in pressure will cause the walls of the chambers to distend, forming an uneven surface which can require that the cushioning sole be foam encapsulated, which results in the further drawbacks discussed above.

SUMMARY OF THE INVENTION

The present invention is directed to a shoe having heel and forefoot areas and including a sole which includes a bladder and a central region. The bladder includes a sealed, fluid-filled tube disposed about the perimeter of the shoe. The tube includes medial and lateral portions and extends about the heel area of the shoe and forward along the medial and lateral sides of the shoe and generally about the forefoot area to define the central region between the medial and lateral portions. The central region occupies a substantial portion of the heel and forefoot areas.

In a further embodiment the tube contains a gas which is pressurized above ambient pressure.

In a further embodiment, the central region is occupied by ambient air.

In a further embodiment, a second bladder is disposed within the central region. The second bladder is sealed and is isolated out of fluid communication from the tube.

In a further embodiment, the bladder includes a portion extending between the medial and lateral portions of the sealed tube. The shoe further includes a second sealed bladder disposed upon the portion and isolated out of fluid communication from the tube.

A shoe according to the present invention is simple and inexpensive to manufacture. Further since substantially all of the cushioning is provided by the fluid-filled insert, the cushioning characteristics are easily tunable, for example, the cushioning provided at different locations of the shoe can be made to match the expected loads. By eliminating the need for a layer of foam cushioning material in the midsole, the shoe can be made lightweight, and the midsole can undergo maximum deflection to provide cushioning with reduced elevation of the foot

DETAILED DESCRIPTION OF THE PREFERRED EMBODIMENTS

Figure 4A:
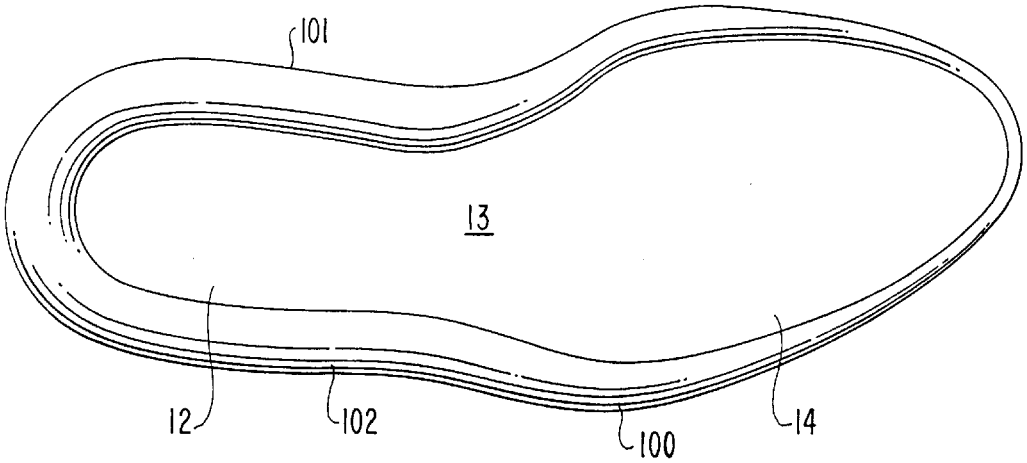
FIG. 4*a* is an overhead view of the bladder according to the present invention as shown in the shoes of FIGS. 1*a* and 2*a*.

With reference to FIGS. 1*a*–1*e,* a shoe, and in particular an athletic shoe, incorporating the present invention, is shown. Shoe 1 includes conventional upper 3 and sole 5. Sole 5 includes midsole 100 and outsole 7. If desired, conventional insole 6 may be disposed on the horizontal surface of upper 3. Outsole 7 is conventional and may include tread members 8. Midsole 100 is a sealed elastomeric bladder containing a fluid such as a gas which may be pressurized above ambient pressure, and is shown in FIG. 4*a*. Midsole 100 includes only the bladder, and no other cushioning element, that is, no further cushioning element such as a layer of foam is required. Upper 3 is secured to the upper surfaces of bladder 100, and outsole 7 is disposed directly beneath bladder 100, and are secured to bladder 100 in a conventional manner, for example, by a conventional adhesive such as cement. No further element is disposed between bladder 100 and each of outsole 7 and upper 3. The outer surfaces of bladder 100 form the exterior surfaces of the sole at all locations above outsole 7 and below upper 3, and entirely about the periphery of the shoe.

With further reference to FIG. 4*a,* the structure of bladder 100 is shown. Bladder 100 is a sealed, fluid-filled, continuous hollow tube having a shape which approximates the outline of a wearer's foot. The cross-sectional shape of bladder 100 is generally circular, with the cross-section having a larger diameter at the heel or rearfoot, for example, 20 mm, and diminishing towards the forefoot, for example, to 10 mm. As discussed further below, bladder 100 is disposed about the periphery or perimeter of shoe 1 and surrounds an essentially empty region or space 13, that is, a space containing no further elements of the shoe. Accordingly, space 13 may contain air at ambient pressure. Bladder 100 preferably is pressurized between 15 psi and 50 psi above ambient pressure. Although bladder tube 100 is disclosed as having a circular cross-section, tube 100 could also have other cross-sectional shapes, for example, oval or rectangular.

Bladder 100 may be made by any known technique, for example, by blow-molding in which a liquified elastomeric material is placed in a mold having the desired overall shape and configuration of bladder 100. The mold has an opening at one location through which pressurized air is provided. The pressurized air forces the liquified elastomeric material against the inner surfaces of the mold and causes the material to harden in the mold to form a bladder having the preferred shape. Preferred materials from which bladder 100 may be made and preferred gases which may be used to inflate bladder 100 include those disclosed in the above-referenced U.S. Pat. No. 4,817,304, for example, the bladder may be made of: polyurethane; ethylene vinyl acetate/polyethylene copolymer; ethylene vinyl acetate/polypropylene copolymer; neoprene; or polyester, and may be inflated with hexafluoroethane or sulfur hexafluoride.

When completely constructed, shoe 1 includes bladder 100 disposed about the perimeter of the shoe. Bladder 100 includes medial portion 101 and lateral portion 102 which jointly extend about the heel area of shoe 1, and forward along the medial and lateral sides of shoe 1 towards and about the forefoot area. As shown, bladder 100 may be disposed about the entire perimeter of shoe 1 and thereby entirely surround central region 13, defining central region 13 to occupy a substantial portion of forefoot area 14 and rearfoot or heel area 12 of sole 15. In general, the heel area of the sole would underlie the calcaneus and talus bones of the foot, and the forefoot area would underlie the phalanges and the distal ends of the metatarsals. No portion of the sealed tube extends into the central region. Thus, central region 13 is an empty space, and may contain only air at ambient pressure.

The total area of the sole may be defined within the perimeter of the sole. Central region 13 also encompasses an area. The size of the latter area is a substantial fraction of the size of the former area. Preferably, the area of central region 13 is at least half the size of the total area of the sole. For example, the area of the sole corresponding to a man's size 9 shoe may be 35.91 square inches, and the area of central region 13 may be 21.34 square inches. Thus, the area of the central region may be 59.4% of the total area of the sole.

Figure 4B:
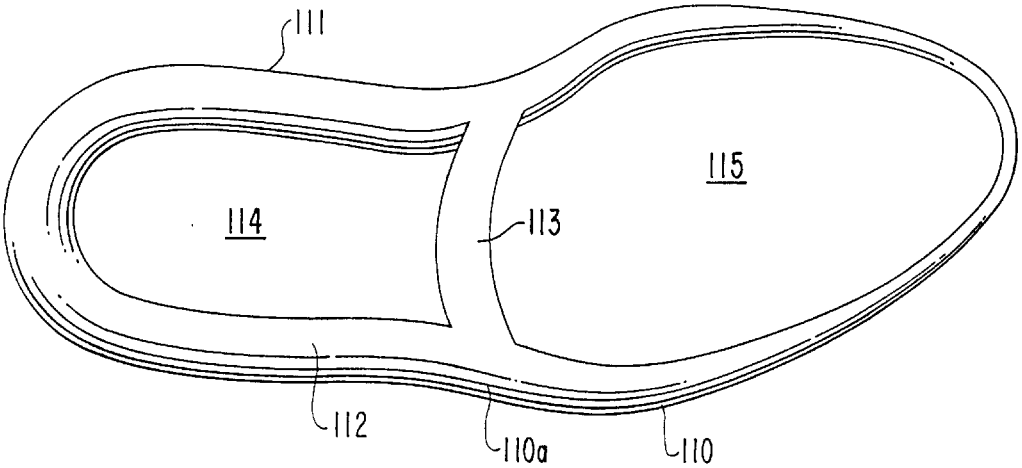
FIGS. 4*b*–4*n* are overhead views of variations of the bladder according to the invention.
Figure 4C:
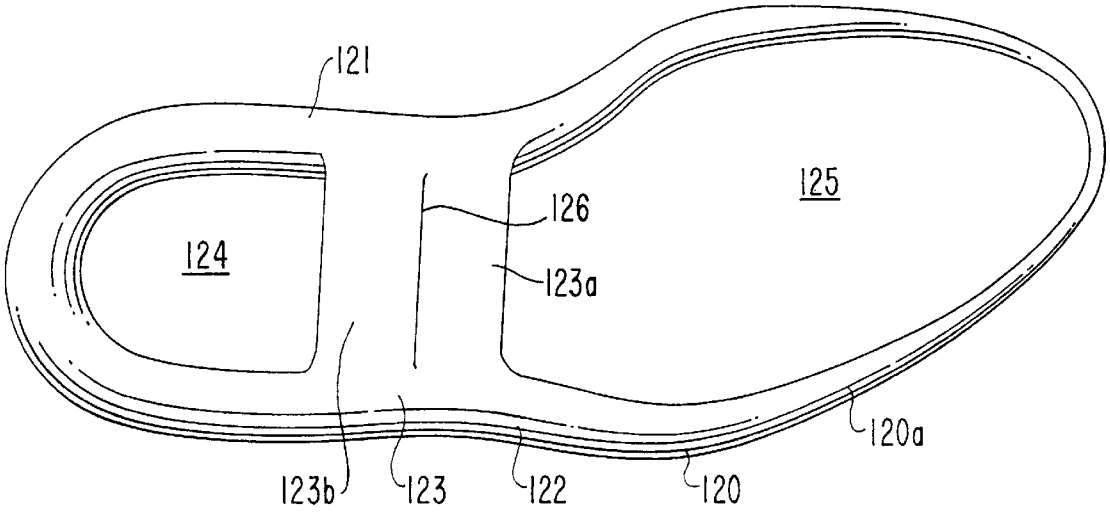
Figure 4D:
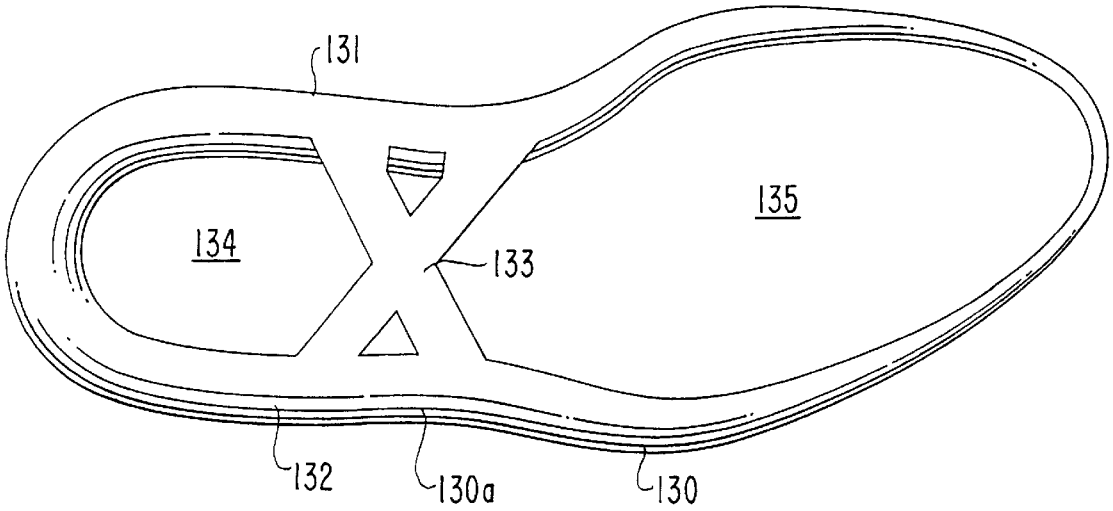
Figure 4E:
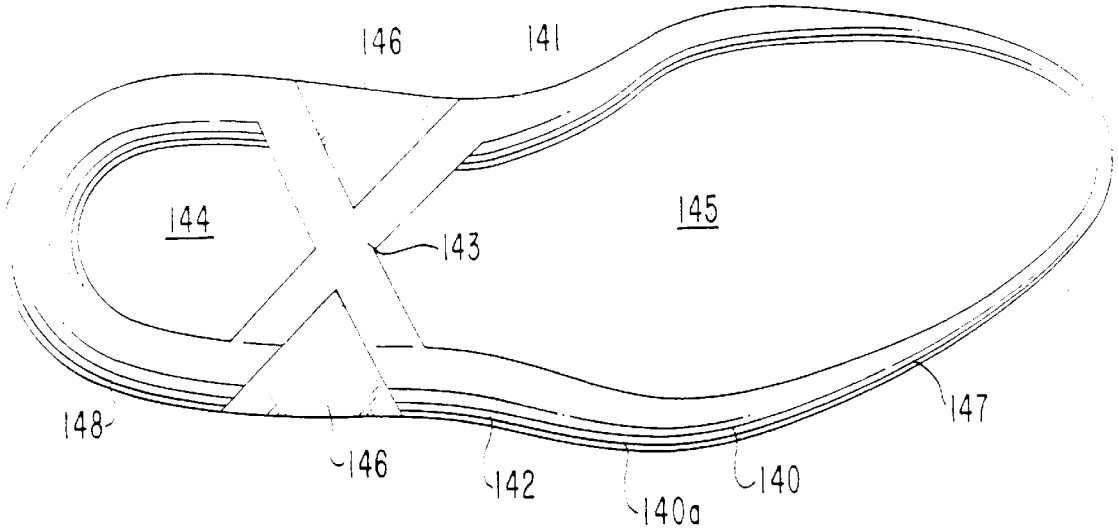
Figure 4F:
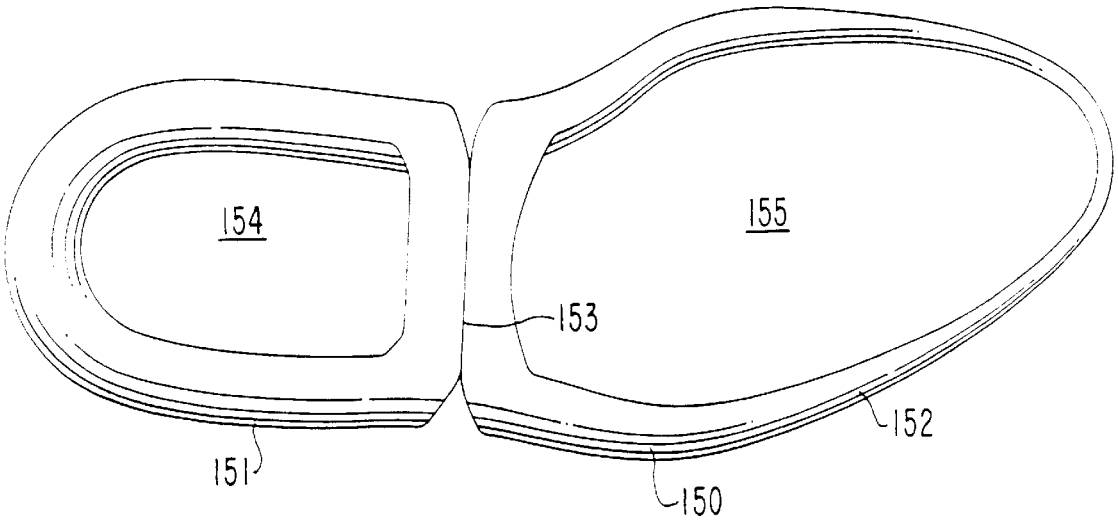
Figure 4G:
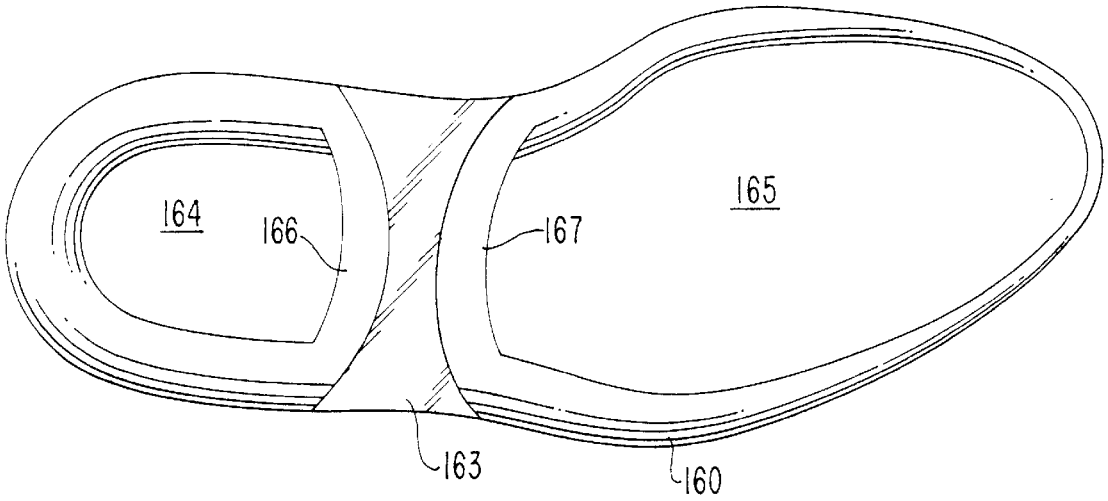
Figure 4H:
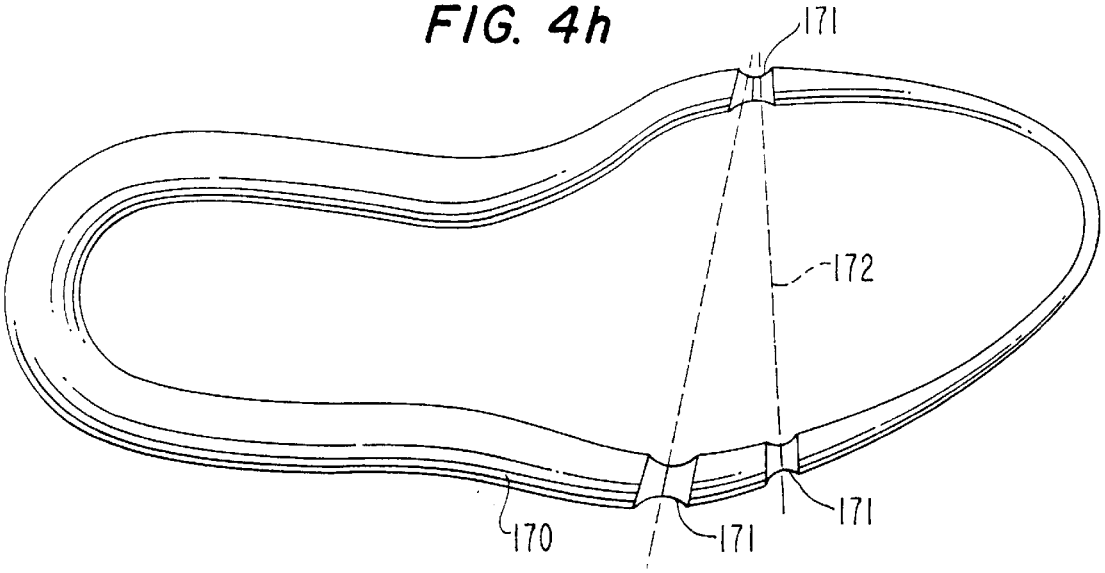
Figure 4I:
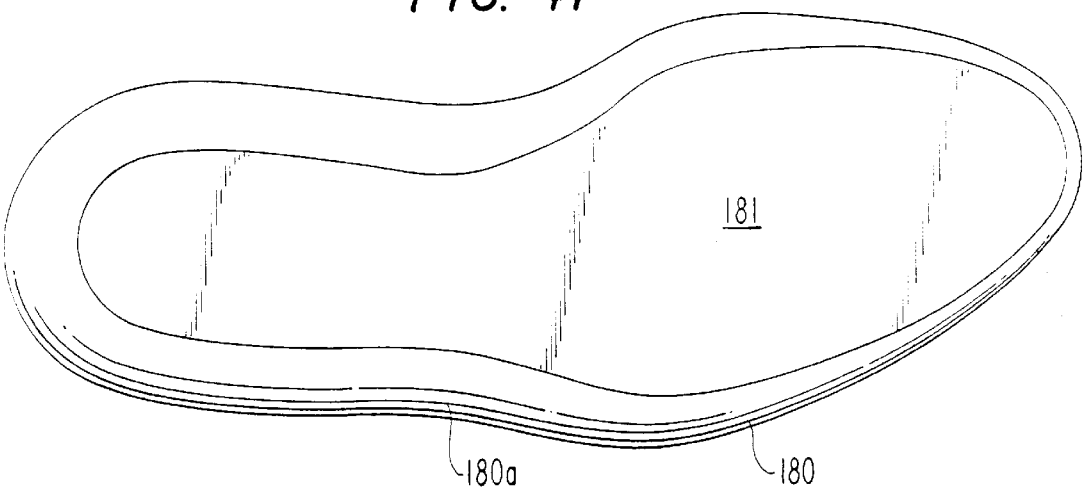

In the embodiment of FIGS. 1*a*–1*e* and 4*a,* bladder 100 extends about the entire periphery of the shoe, defining central region 13, and bladder 100 encompasses substantially all of both the heel and forefoot areas of the sole. Alternatively, medial portion 101 and lateral portion 102 could terminate along the sides of the forefoot and/or along the extreme rear edge of the heel so as to leave a gap, as in bladder 100' and in bladder 100", shown in FIGS. 4*m* and 4*n,* respectively. That is, the tube could extend generally about the heel and forefoot area of the shoe. In this situation, though central region 13 would still occupy a substantial portion of the sole, central region 13 would not be completely surrounded. That is, central region 13 may occupy a substantial portion of the heel and/or forefoot areas.

Upper 3 bridges the lateral and medial portions of bladder 100, and along with outsole 7, provides an upper and lower boundary, respectively, for central region 13. Since upper 3 generally is made of a relatively thin and flexible material, downward force from the foot is transferred freely through upper 3 to bladder 100, which compresses. Simultaneously, upward force is applied to outsole 7 by ground contact, and this force is transmitted directly to bladder 100. Bladder 100 compresses and dampens due to the applied forces to provide cushioning of the impact force. Since bladder 100 is compressible, and outsole 7 is substantially incompressible, bladder 100 provides substantially the entire cushioning for the shoe. Thus, the cushioning characteristics for the shoe are determined substantially entirely by bladder 100, which can be engineered and manufactured to provide desired cushioning quality.

Bladder 100 provides support for the foot. However, since bladder 100 does not extend into central region 13, the effective volume of bladder 100 is small relative to the overall area of the shoe it covers. That is, in prior art shoes in which the bladders extend entirely across the width and length of the shoe, the volume of the bladder would be approximately equal to the area of the sole times the height of the bladder. However, the volume of bladder 100 according to the invention is approximately equal to the cross-sectional area of the tube times the overall length, which is significantly less than a shoe constructed according to the prior art. Due to the relatively low effective volume, bladder 100 can be pressurized to a level sufficient to provide adequate cushioning, without sacrificing stability by under-pressurizing, or on the other hand, sacrificing compressibility by over-pressurizing. In a preferred embodiment, bladder 100 may be pressurized to 35–40 psi above ambient pressure.

With reference to FIGS. 2*a*–2*g,* a shoe according to a variation of the invention is disclosed. Shoe 10 further includes footframe 9 disposed directly above bladder 100. Upper 3 is secured to footframe 9. The outer surfaces of bladder 100 form the exterior surfaces of the sole at all locations above outsole 7, below footframe 9 and entirely about the periphery of the shoe. Footframe 9 includes horizontal surface portion 9*a* extending across the width and length of the shoe such that a substantial portion of the foot of the wearer imparts a load upon the upper surface of footframe 9. Footframe 9 includes an upwardly extending peripheral region which serves to provide stability to the foot. The lower side of footframe 9 includes a recessed region formed about the periphery and outlining the same overall shape as bladder 100, and shaped to conform to the upper surfaces of the bladder. Bladder 100 is secured to footframe 9 at the peripheral recessed region in a conventional manner, for example, by a conventional adhesive. Footframe 9 thus spans or bridges the lateral and medial portions of bladder 100, and provides an upper boundary for central region 13. Bladder 100, outsole 7 and footframe 9 jointly enclose central region 13.

The material from which footframe 9 is manufactured, for example, nylon, can be flexible or semi-rigid when free-standing. However, when shoe 10 is manufactured, the stiffness of footframe 9 is increased due to adhesion to the shoe upper and sole elements. Thus, in assembled shoe 10, footframe 9 can be semi-rigid or rigid and incompressible, allowing for transfer of applied forces to bladder 100. The upper flat surface of footframe 9 provides a platform for distributing loads imparted to the sole. Footframe 9 bridges the lateral and medial sides of bladder 100, transferring downward force from the foot to bladder 100, which compresses. Simultaneously, upward force is applied to outsole 7 by ground contact, and this force is transferred directly to bladder 100.

As in the above-discussed embodiment, bladder 100 compresses due to the applied forces to provide cushioning against impact. Since bladder 100 is compressible, and footframe 9 and outsole 7 are substantially incompressible, bladder 100 provides substantially the entire cushioning for the shoe. Thus, the cushioning characteristics for the shoe are determined substantially entirely by bladder 100.

Figure 2H:
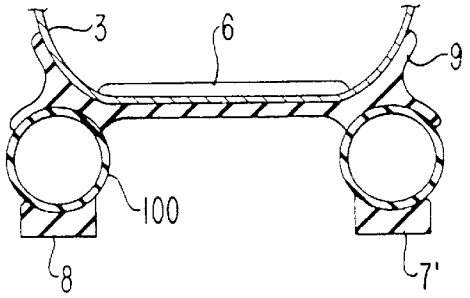
FIG. 2*h* is a transverse cross-sectional view of a variation of the shoe shown in FIGS. 2*a*–2*g*.

FIG. 2*h* shows a variation of the embodiment shown in FIGS. 2*a*–2*g*. Outsole 7' is modified so as to include only a peripheral portion which is disposed beneath bladder 100. Since the central portion of the outsole is eliminated, the bottom of the shoe is open to footframe 9.

Figure 1A:
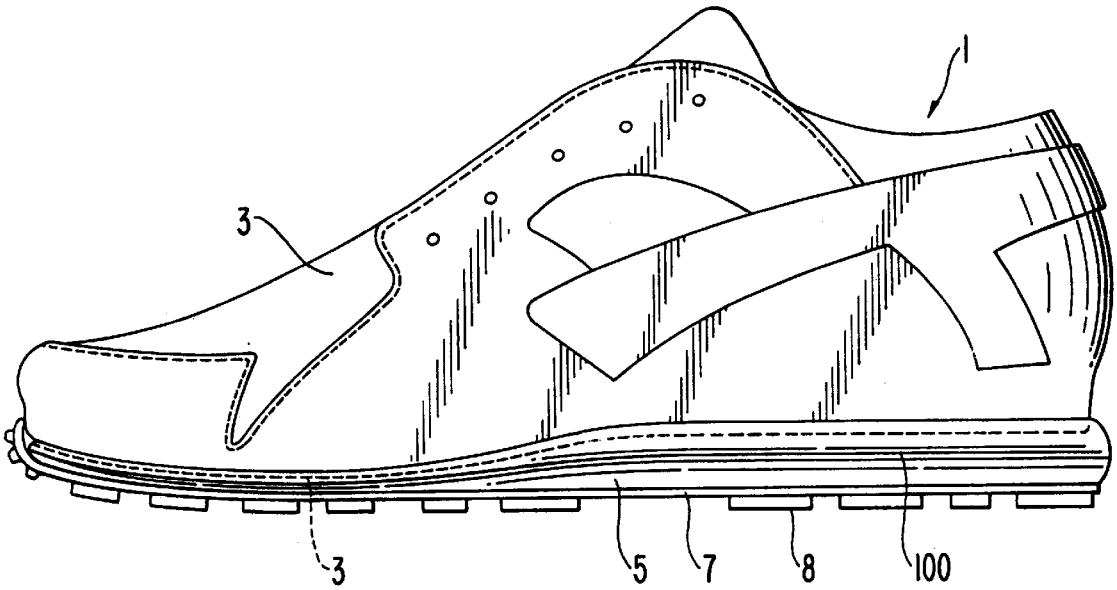
FIG. 1*a* is a side view of a shoe including a bladder according to the invention.
Figure 1B:
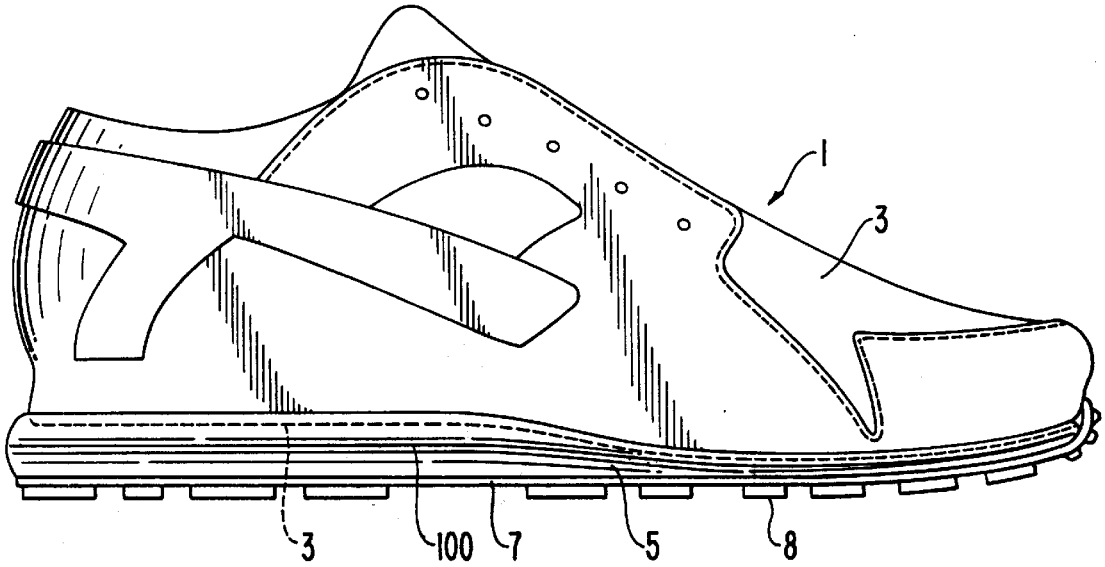
FIG. 1*b* is an opposite side view of the shoe shown in FIG. 1*a*.
Figure 1C:
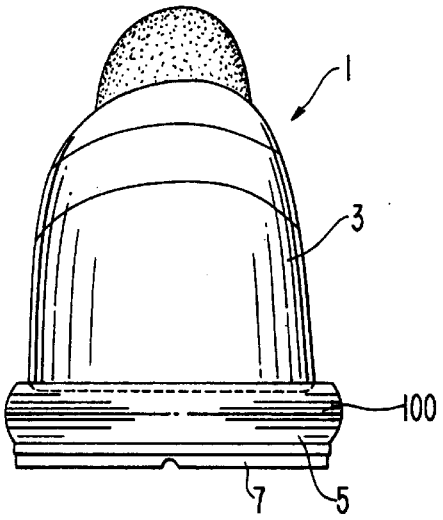
FIG. 1*c* is a rear view of the shoe shown in FIG. 1*a*.
Figure 1D:
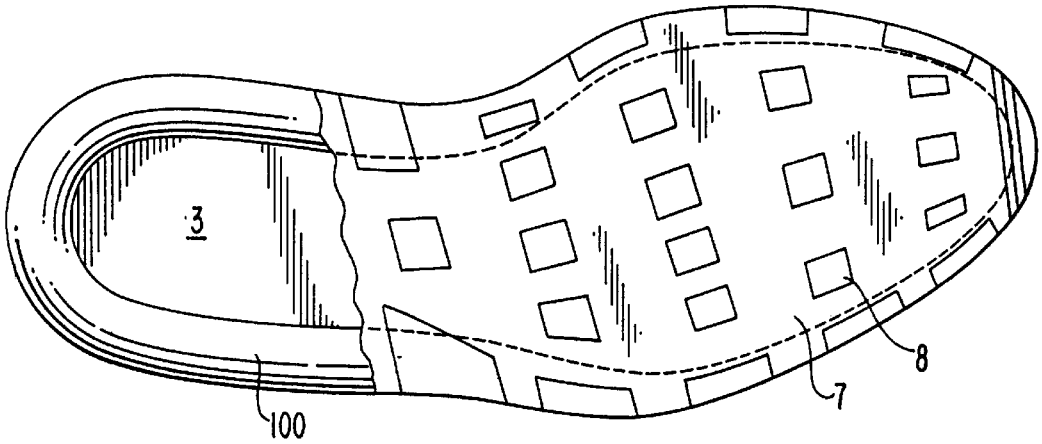
FIG. 1*d* is a partially broken away underside view of the shoe shown in FIG. 1*a*.
Figure 1E:
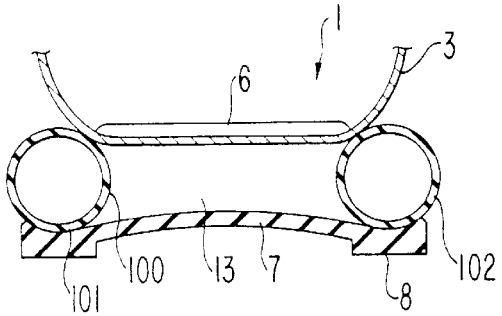
FIG. 1*e* is a transverse cross-sectional view of the shoe shown in FIG. 1*a*.
Figure 2E:
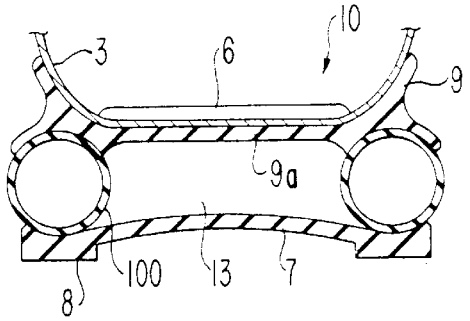
FIGS. 2*a*–2*e* are views corresponding to the views of FIGS. 1*a*–1*e* for a variation of the shoe shown therein.
Figure 3A:
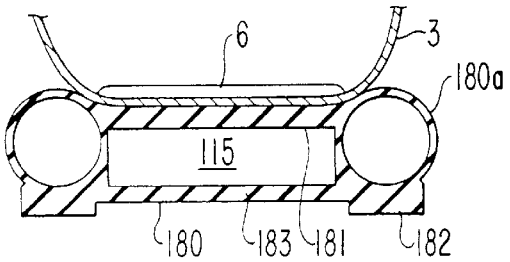
FIGS. 3*a*–3*c* are transverse cross-sectional views of variations of the shoe shown in FIGS. 1*a*–1*e*.
Figure 3B:
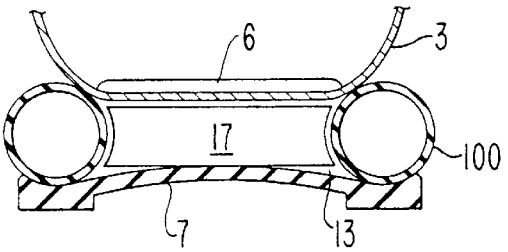
Figure 3C:
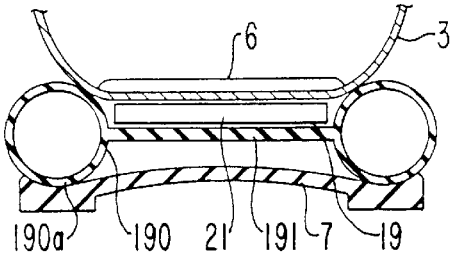
Figure 2A:
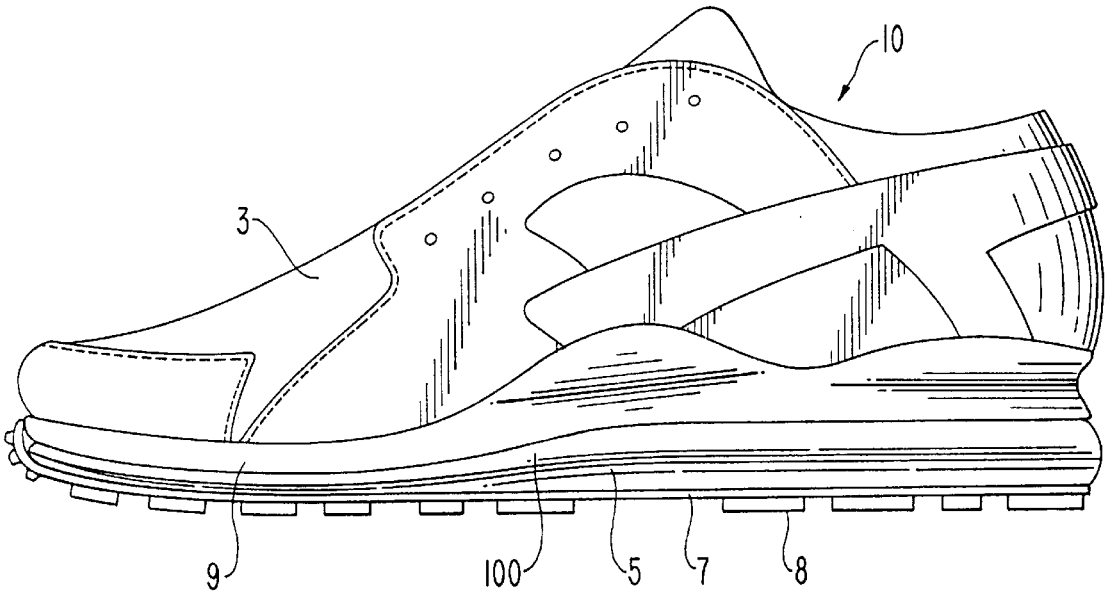
Figure 2B:
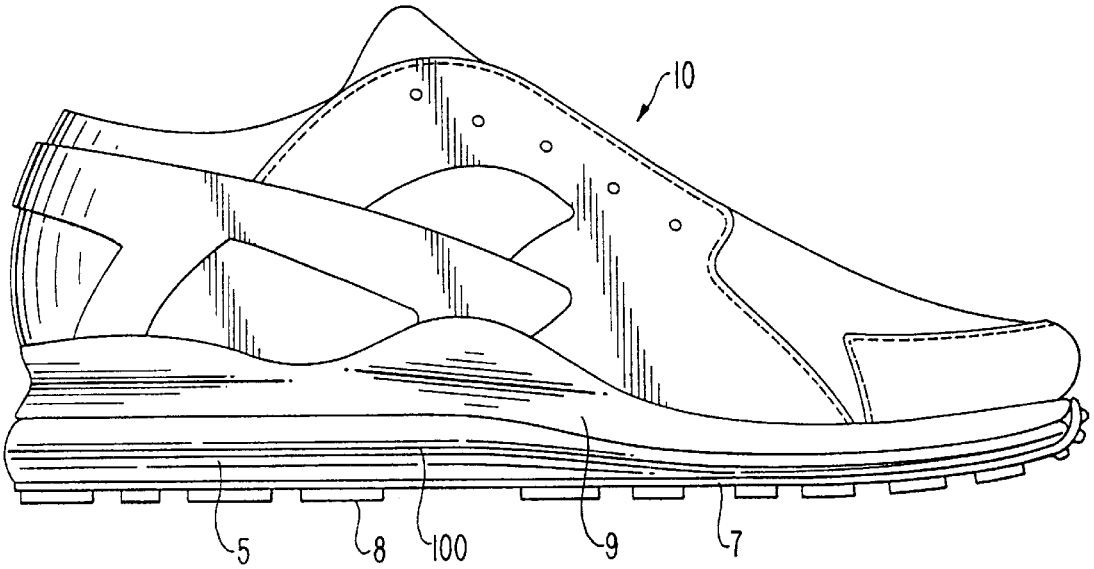
Figure 2C:
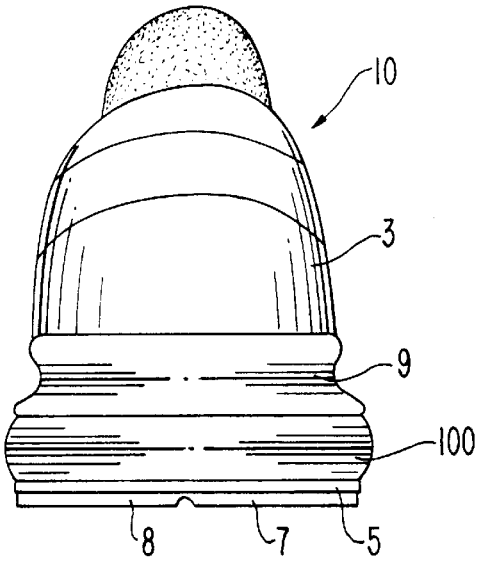
Figure 2D:
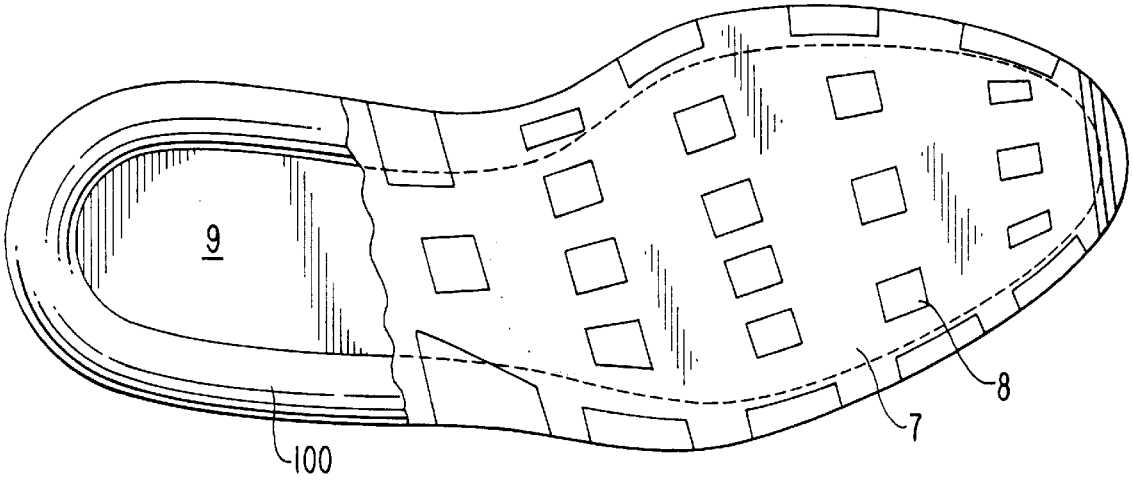
Figure 2F:
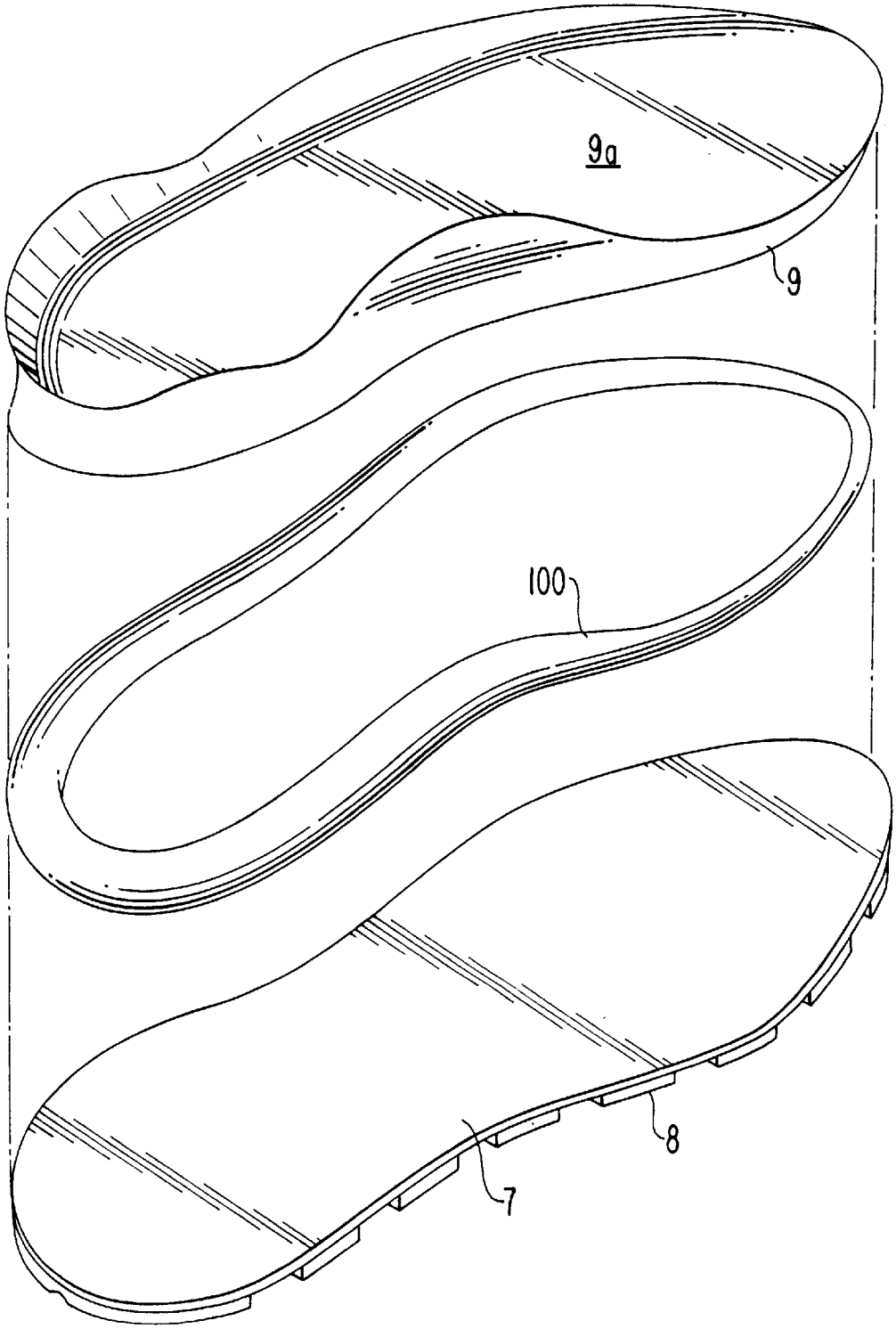
FIG. 2*f* is an exploded perspective view of the outsole, bladder and footframe of the shoe shown in FIGS. 2*a*–2*e*.
Figure 2G:
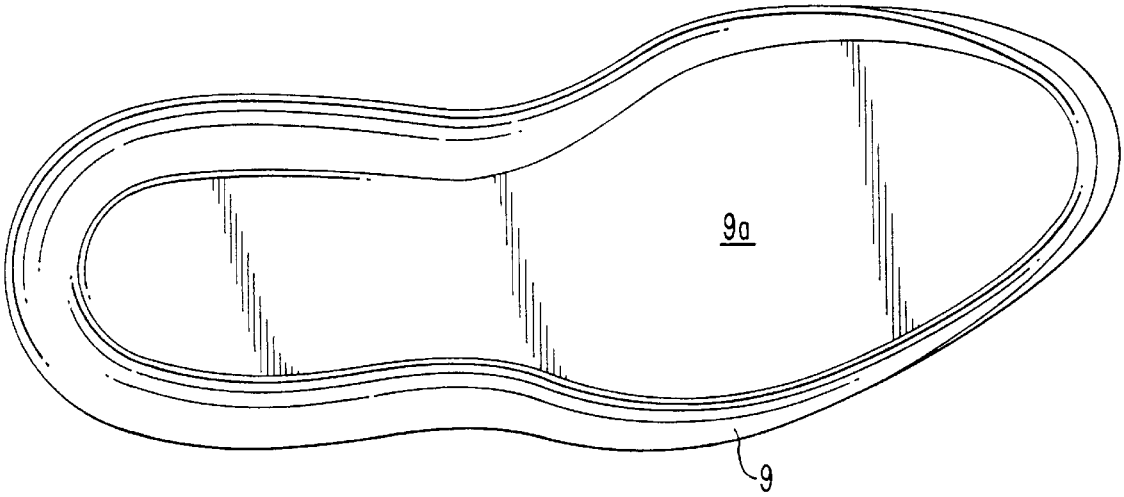
FIG. 2*g* is an underside view of the footframe shown in FIGS. 2*a*–2*f*.

With reference to FIGS. 3*a*–3*c,* 4*i* and 4*j,* variations of a bladder according to the present invention are shown. In FIGS. 3*a* and 4*i,* bladder 180 includes bladder tube 180*a* having substantially the same form as bladder 100 in the above-described embodiments. Bladder 180 also includes integrally formed, upper horizontal surface portion 181 extending between the upper surfaces of the medial and lateral portions of bladder tube 180*a,* and lower horizontal surface layer 183 extending between the lower surfaces of the medial and lateral portions. Bladder tube 180*a* and layers 181 and 183 define a sealed interior chamber 115 which may be filled with fluid, for example, the same types of pressurized gases used to inflate tube 180. Pressurized chamber 115 would serve to enhance comfort and act as a secondary cushion, supporting and cushioning the foot against larger loads, which might exceed the cushioning capability of the primary cushioning provided by bladder tube 180. However, since bladder tube 180 and chamber 115 are isolated out of fluid communication from each other, the provision of chamber 115 has no direct effect upon the stiffness in compression exhibited by bladder tube 180.

Figure 5:
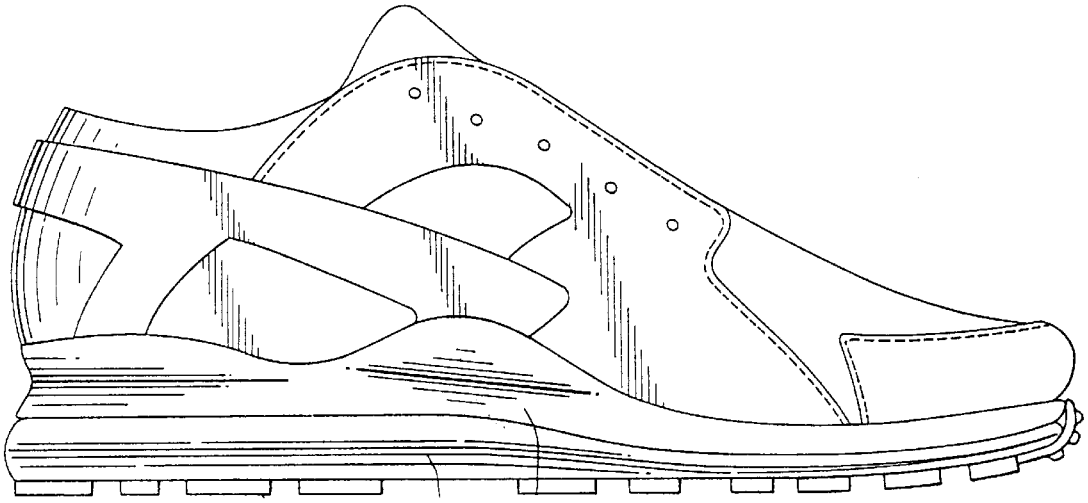
FIG. 5 is a side view of shoe according to the invention in which the bladder and outsole are formed as one integral element.

As shown with further reference to FIG. 3*a* and to FIG. 5, bladder 180 may include integrally formed peripherally disposed tread members 182, thereby eliminating the need for a separate outsole. That is, the bladder and outsole are combined into one element. Bladder 180 would thus comprise the entire midsole and outsole for the shoe. The integrated bladder tube 180 and treads 182 can be made of the same material and are formed simultaneously, for example, by the blow-molding technique discussed above. Accordingly, by elimination of a separate outsole, a lighter shoe may be manufactured with less expense. As shown in FIG. 5, the shoe could further include footframe 9 as described above.

With reference to FIG. 3*b,* a shoe is shown which is similar in construction to the embodiment of FIGS. 1*a*–1*e,* and includes upper 3 disposed directly above bladder tube 100 to define an upper boundary for central region 13. In FIG. 3*b,* a separate fluid-filled bladder 17 is disposed within central region 13. Bladder 17 rests upon the upper surface of outsole 7. Bladder 17 may be pressurized, and would serve generally the same function as enclosed chamber 115 in FIG. 3*a*.

Figure 4J:
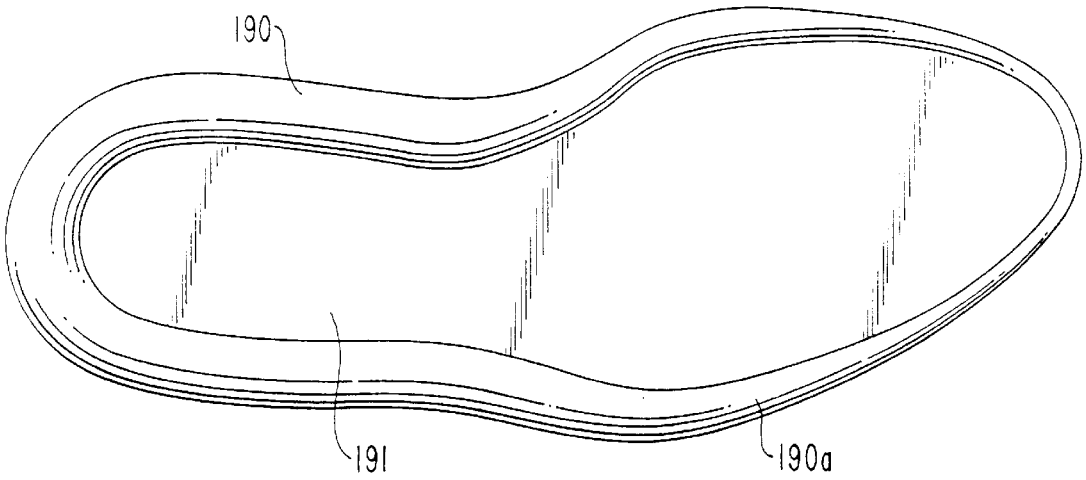
Figure 4L:
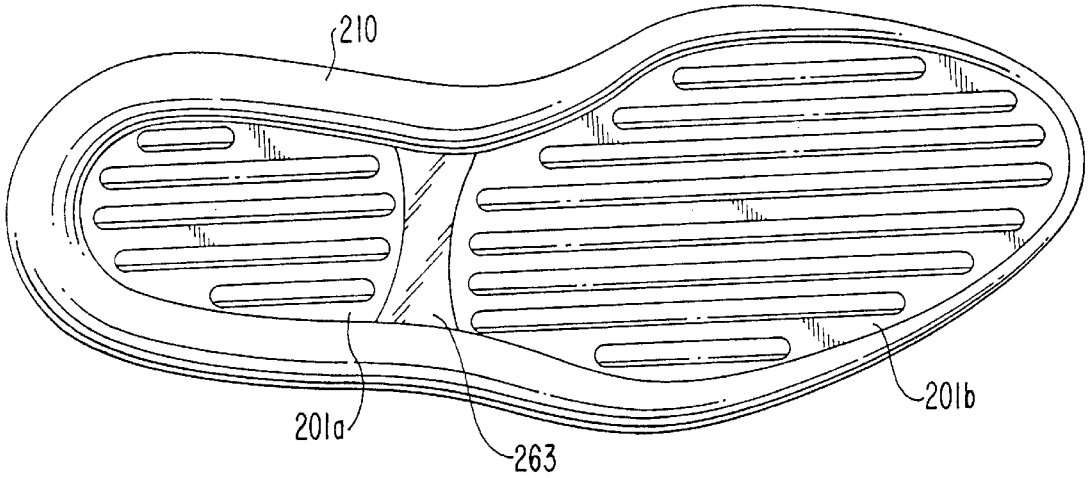

With reference to FIGS. 3*c* and 4*j,* bladder 190 includes bladder tube 190*a* and horizontal layer 191 extending between the medial and lateral portions of the tube. Layer 191 is disposed at a location between the upper and lower surfaces of tube 190*a*. Layer 191 and the lower surface of upper 3 jointly form enclosed chamber 19, generally at the location of central region 13 as shown in the above-discussed figures. Separate fluid-filled bladder 21 is disposed in chamber 19 and may be pressurized. Bladder 21 is isolated from bladder tube 190*a* and serves substantially the same purpose as interior chamber 115 in FIG. 3*a* and bladder 17 in FIG. 3*b*. Bladder 21 could be a flat cushioning bladder as disclosed in any one of U.S. Pat. Nos. 5,245,766, 5,083,361 or 4,906,502, incorporated by reference.

With reference to FIGS. 4*b*–4*h* and 4*l,* further variations of the bladder according to the invention are shown. In FIG. 4*b,* bladder 110 includes sealed, fluid-filled perimeter tube 110*a* including medial portion 111 and lateral portion 112 which would be disposed about the perimeter of the shoe, as shown in the above-discussed figures. Bladder 110 further includes transverse portion 113 extending between medial portion 111 and lateral portion 112 at a location which would be between the heel and forefoot area of the shoe, that is, at an arch or instep area. Transverse portion 113 is in fluid communication with perimeter bladder tube 110*a* at both ends. Transverse portion 113 and the section of medial portion 111 and lateral portion 112 which are disposed rearwardly of transverse portion 113 surround and define central heel region 114 generally at the heel area of the sole. Transverse portion 113 and the section of medial portion 111 and lateral portion 112 which are disposed forwardly of transverse portion 113 surround and define central forefoot region 115 generally at the forefoot area of the sole.

Transverse portion 113 is arc-shaped and would be disposed under the arch or instep of the foot, in general, between the plantar tubercle of the calcaneus and the metatarsal heads. Like central region 13, central heel region 114 and central forefoot region 115 are empty space, that is, contain only air at ambient pressure, and generally are defined below the plantar surface portion of the heel and the ball of the foot, respectively. Accordingly, bladder 110 provides additional stability for the foot by supporting the arch. However, since the arch area generally receives a relatively light load, and since an empty space is maintained underlying the relatively heavily loaded areas beneath the ball and heel, cushioning can be enhanced by way of decreased localized stiffness in compression underlying these areas, resulting in greater deflection and thus reducing peak acceleration and shock being transmitted to a wearer. Further, since even with the inclusion of transverse portion 113, the overall volume of the bladder remains small, the bladder can be inflated to a pressure which provides adequate cushioning and stability.

With reference to FIG. 4*c,* bladder 120 is shown. Bladder 120 is similar in structure to bladder 110, including perimeter bladder tube 120*a* having transverse portion 123 at the instep area which defines central heel region 124 and central forefoot region 125. Transverse portion 123 includes two sections 123*a* and 123*b* divided by an interior wall 126. Each section 123*a* and 123*b* is in communication with medial portion 121 and lateral portion 122 of bladder 110.

With reference to FIG. 4*d,* bladder 130 includes perimeter tube 130*a* having medial portion 131, lateral portion 132, and transverse portion 133 extending between the lateral and medial portions at the instep area. Transverse portion 133 is "X-shaped" and gives bladder 130 an overall "figure-eight" shape. Each end of transverse portion 133 is in fluid communication with tube 130*a*. FIG. 4*e* discloses bladder 140 having a similar structure. Bladder 140 includes perimeter tube 140*a* having medial portion 141, lateral portion 142 and "X-shaped" transverse portion 143. Flat surface areas 146 are formed between the outer quadrants of the "X". Thus, bladder 140 is divided into separate central forefoot chamber 147 and central heel chamber 148 which are in fluid communication with each other. Forefoot chamber 147 surrounds and defines central forefoot region 145 and heel chamber 148 surrounds and defines central heel region 144.

With reference to FIG. 4*f,* bladder 150 includes separate forefoot bladder tube 152 and heel bladder tube 151, joined together at dividing wall 153. Wall 153 extends between the medial and lateral sides of bladder 150 at the instep area of the shoe. Forefoot tube 152 and heel tube 151 are isolated out of fluid communication with each other. Accordingly, each tube can be tuned to provide a desired quality of cushioning by inflating the tubes to a predetermined pressure. Forefoot tube 152 surrounds and defines central forefoot region 155 and heel tube 151 surrounds and defines central heel region 154. Tubes 151 and 152 are integral and can be formed simultaneously, for example, by blowmolding.

With reference to FIG. 4*g,* bladder 160 includes separate forefoot tube 167 and heel tube 166. Tubes 166 and 167 are joined together by generally flat portion 163 disposed at the instep area and are isolated out of fluid communication from each other. Forefoot tube 167 surrounds and defines central forefoot region 165 and heel tube 166 surrounds and defines central heel region 164. Tubes 166 and 167, and generally flat portion 163 can be manufactured simultaneously, for example, by blowmolding.

With reference to FIG. 4*h,* tubular bladder 170 is shaped similarly to bladder 100 shown in FIG. 4*a*. Bladder 170 includes flex portions 171 having a narrower diameter than the remainder of the bladder. Flex portions 171 are disposed along desired lines of flexion 172 of the forefoot. Flex portions 171 may be disposed above similar flex grooves formed in the outsole, for example, as disclosed in U.S. Pat. No. 4,562,651.

Figure 4K:
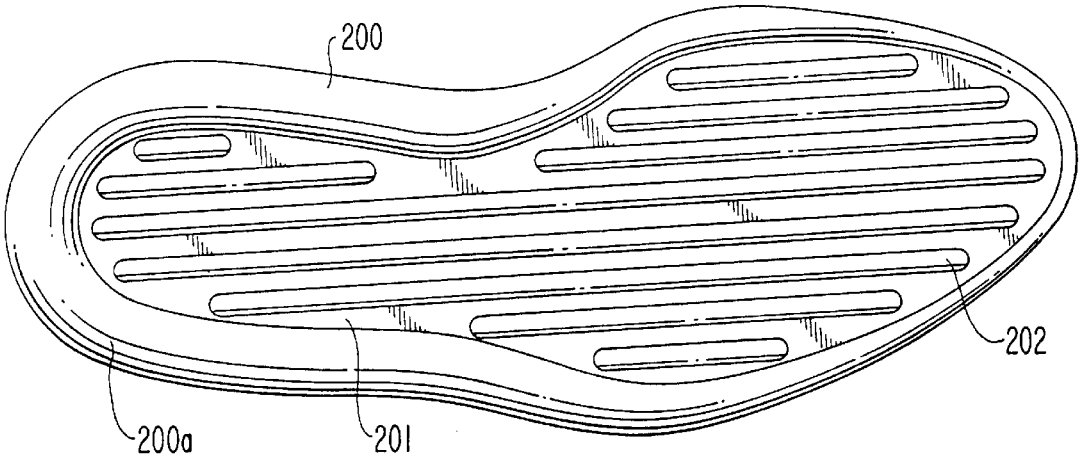
Figure 4M:
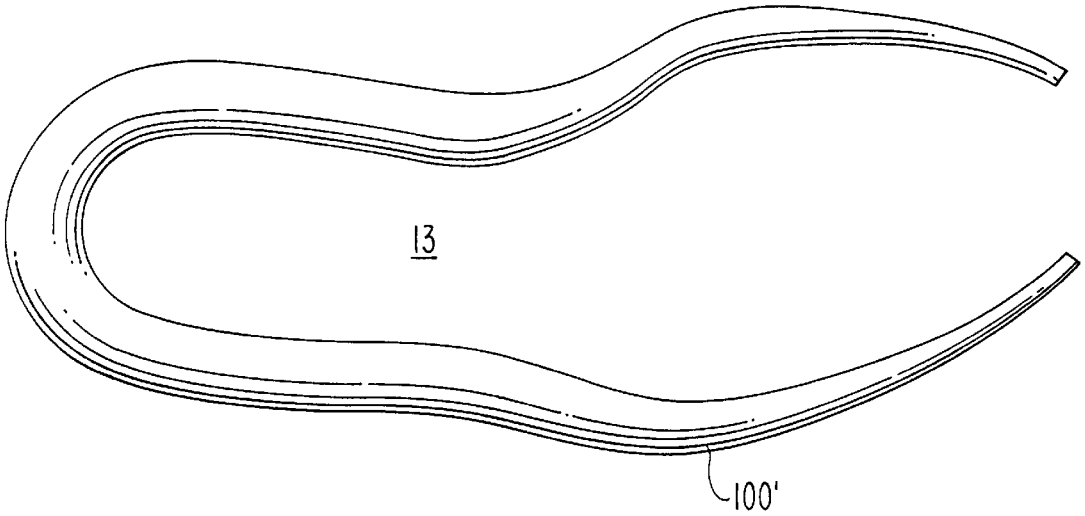
Figure 4N:
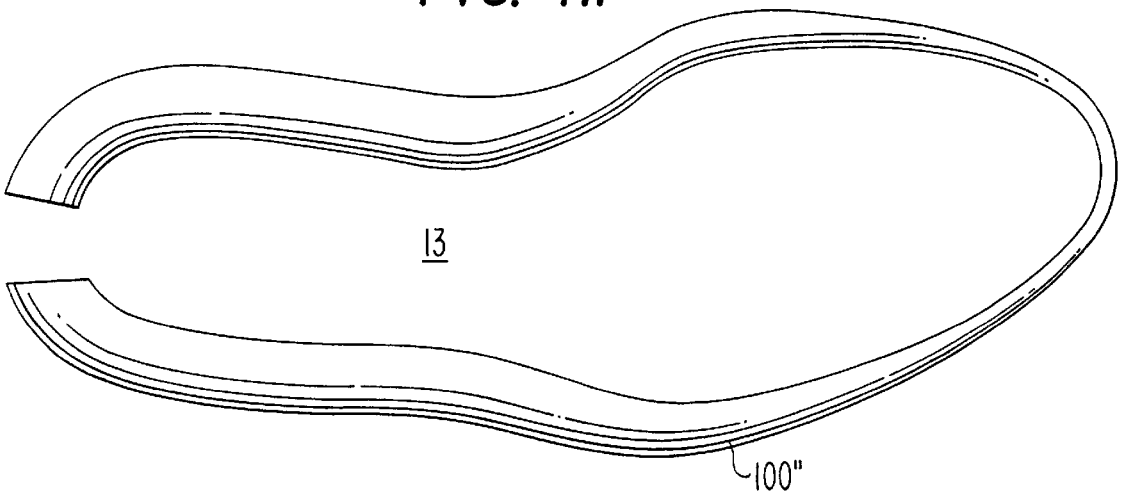

With reference to FIG. 4*k,* bladder 200 is shown and includes perimeter tube 200*a* and essentially flat chamber 201 extending within the central region defined by tube 200*a*. Flat chamber 201 is formed with raised portions 202 which serve the purpose of defining a general support surface for underlying a wearer's foot. Tube 200*a* and chamber 201 are isolated out of fluid communication with each other. The thickness of flat chamber 201 is significantly less than that of tube 200*a,* for example, 6–10 mm as opposed to 10–20 mm.

Chamber 201 may be pressurized to enhance comfort or provide additional cushioning for extremely large loads to prevent bottoming-out. However, since tube 200*a* and chamber 201 are not in fluid communication, the volume enclosed by and the pressurization of chamber 201 have no direct effect on the compressibility of tube 200*a*. Thus, tube 200*a* can be pressurized to provide a predetermined level of cushioning without compromising stability.

If desired, as shown in FIG. 41 with respect to bladder 210, chamber 201 may be manufactured as distinct rearfoot chamber 201*a* and forefoot chamber 201*b,* with the rearfoot chamber pressurized, for example, to 5 psi above ambient, so as to provide a low pressure calcaneus cushioning pad relative to the forefoot chamber which may be pressurized, for example, to 10–35 psi above ambient Bladder 210 may include non-pressurized flat portion 263 which isolates chambers 201*a* and 201*b* out of fluid communication. Further, one or more portions of chamber 201 can be manufactured with a dot weld pattern.

This invention has been described in detail in connection with the preferred embodiments. These embodiments, however, merely are for example only and the invention is not restricted thereto. It will be understood by those skilled in the art that other variations and modifications can easily be made within the scope of this invention as defined by the claims.

We claim:

1. A shoe comprising a sole having heel and forefoot areas, said sole comprising an inner sole adapted to contact and support a wearer's foot, an outsole with a ground engaging outer surface covering said heel and forefoot areas and adapted to engage a ground surface, and a midsole interposed between said inner sole and said outsole said midsole spacing said inner sole from said outsole in both static and loaded conditions, said midsole comprising a bladder including a sealed, fluid-filled tube with resilient elastomeric walls disposed about a perimeter of said sole and extending generally about the heel area of said shoe and forward along the medial and lateral sides of the shoe and generally about the forefoot area to define a central region occupied by air at ambient pressure between the medial and lateral sides, said central region occupying a substantial portion of the heel and forefoot areas.

2. The shoe recited in claim 1 further comprising a second bladder disposed within the central region, wherein, said second bladder is sealed and is isolated out of fluid communication from said tube.

3. The shoe recited in claim 1, said bladder including a portion extending between the medial and lateral sides, said shoe further comprising a second permanently sealed bladder disposed upon said portion, said second sealed bladder isolated out of fluid communication from said tube.

4. A shoe comprising a sole comprising an inner sole adapted to contact and support a wearer's foot, an outsole with a ground engaging outer surface covering said heel and forefoot areas and adapted to engage a ground surface, and a midsole interposed between said inner sole and said outsole said midsole spacing said inner sole from said outsole in both static and loaded conditions, said sole having heel and forefoot areas, said midsole comprising a bladder, a central forefoot region and a central heel region, said bladder including a sealed, fluid-filled tube disposed about the perimeter of said shoe, said tube including medial and lateral portions and extending generally about the heel area of said shoe and forward along the medial and lateral sides of said shoe and generally about the forefoot area and a transverse portion extending between and in fluid communication with said medial and lateral portions, said medial, lateral and transverse portions defining said central heel region and said central forefoot region, wherein no portion of said tube extends into said central heel region and said central forefoot region.

5. The shoe recited in claim 4, said medial and lateral portions disposed about the entire perimeter of said shoe, wherein, said medial, lateral and transverse portions jointly entirely surround the central forefoot region.

6. The shoe recited in claim 4, wherein the central heel region is occupied by ambient air.

7. The shoe recited in claim 4, said transverse portion comprising an X-shaped crossing member.

8. The shoe recited in claim 4, the fluid comprising a gas, said tube pressurized above ambient pressure by the gas.

9. The shoe recited in claim 4, said tube having a generally circular cross-sectional shape.

10. The shoe recited in claim 4, wherein, the central heel region and central forefoot region have a combined area which is at least half of the total area of the sole.

11. A shoe having heel, forefoot and instep areas and comprising a sole, said sole comprising a bladder and a central forefoot region, said bladder including a sealed, fluid-filled tube, said tube having medial and lateral portions disposed generally about the forefoot area at the perimeter of said shoe and a transverse fluid-filled portion extending between and in fluid communication with said medial and lateral portions in the instep area, said medial, lateral and transverse portions generally defining said central forefoot region, said sole further comprising an outsole with a ground engaging outer surface covering said heel and forefoot areas and adapted to engage a ground surface.

12. The shoe recited in claim 11 further comprising a second bladder and a central heel region, said second bladder including a second sealed, fluid-filled tube, said second tube including medial and lateral portions disposed substantially about the heel area at the perimeter of said shoe and forward along the medial and lateral sides of the shoe and a transverse portion extending between and in fluid communication with said medial and lateral portions in the instep area, said medial, lateral and transverse portions of said second tube defining said central heel region.

13. The shoe recited in claim 12, said second bladder formed integrally with said first bladder.

14. The shoe recited in claim 11, wherein, the central forefoot region is occupied by ambient air.

15. The shoe recited in claim 11, the fluid comprising a gas, said tube pressurized above ambient pressure by the gas.

16. The shoe recited in claim 11, wherein, the central forefoot region has an area which is at least half of the total area of the forefoot area of the shoe.

17. The shoe recited in claim 11, said tube having a generally circular cross-sectional shape.

18. A shoe comprising a sole having heel and forefoot areas, medial and lateral sides and defining a perimeter, said sole comprising:

an inner sole adapted to contact and support a wearer's foot;

a unitary outsole member with a continuous ground engaging outer surface covering said heel and forefoot areas and adapted to engage a ground surface; and a midsole interposed between said inner sole and said outsole, said midsole comprising a bladder including a sealed, fluid-filled tube with resilient elastomeric walls disposed about the perimeter of said sole and extending generally about the heel area, along the medial and lateral sides and generally about the forefoot area to define a central region.

* * * * *